US009974396B2

(12) United States Patent
Sozzo et al.

(10) Patent No.: US 9,974,396 B2
(45) Date of Patent: May 22, 2018

(54) BOOSTER SEAT FOR CHILDREN

(71) Applicant: ARTSANA S.P.A., Grandate (CO) (IT)

(72) Inventors: David Sozzo, Milan (IT); Giuseppe Mascarella, Cantu (IT)

(73) Assignee: ARTSANA S.P.A., Grandate (IT)

( * ) Notice: Subject to any disclaimer, the term of this patent is extended or adjusted under 35 U.S.C. 154(b) by 0 days. days.

(21) Appl. No.: 15/344,266

(22) Filed: Nov. 4, 2016

(65) Prior Publication Data

US 2017/0127851 A1 May 11, 2017

(30) Foreign Application Priority Data

Nov. 6, 2015 (IT) ..... 102015000070057

(51) Int. Cl.

| | |
|---|---|
| ***A47D 1/10*** | (2006.01) |
| ***A47B 83/02*** | (2006.01) |
| ***A47D 1/00*** | (2006.01) |
| ***A47D 15/00*** | (2006.01) |

(52) U.S. Cl.

CPC ..... *A47D 1/103* (2013.01); *A47D 1/006* (2013.01); *A47D 15/00* (2013.01)

(58) Field of Classification Search

CPC ..... A47D 1/103; A47D 15/00; A47D 1/006

USPC ..... 297/188.08, 188.13, 148, 256.16, 440.1, 297/440.14, 440.15

See application file for complete search history.

(56) References Cited

U.S. PATENT DOCUMENTS

| | | | | |
|---|---|---|---|---|
| 5,609,389 | A | 3/1997 | Longoria et al. | |
| 6,773,064 | B2 * | 8/2004 | Treen | A47D 1/002 297/153 |
| 7,878,584 | B2 * | 2/2011 | Hu | A47D 15/006 297/188.13 X |
| 8,070,227 | B2 * | 12/2011 | Brunick | B60N 2/286 297/256.1 |
| 8,430,452 | B2 * | 4/2013 | Brunick | B60N 2/286 297/256.1 |
| 8,567,862 | B2 * | 10/2013 | Williams | B60N 2/2806 297/188.13 |
| 9,635,955 | B2 * | 5/2017 | Greger | A47D 1/004 |
| 2003/0067198 | A1 | 4/2003 | Treen et al. | |
| 2004/0084938 | A1 | 5/2004 | Tomas et al. | |
| 2010/0084901 | A1 | 4/2010 | Flannery et al. | |
| 2012/0104816 | A1 | 5/2012 | Flannery et al. | |

FOREIGN PATENT DOCUMENTS

| | | | |
|---|---|---|---|
| WO | 03/024282 | A1 | 3/2003 |
| WO | 2010/039747 | A2 | 4/2010 |
| WO | 2015/030763 | A1 | 3/2015 |

* cited by examiner

*Primary Examiner* — Rodney B White
(74) *Attorney, Agent, or Firm* — Pearne & Gordon LLP

(57) ABSTRACT

A booster seat for children, comprising a seating surface adapted for engagement with the seating surface of an adult chair, a backrest at least one pair of wings connected to the bottom side of the seating surface and designed to be angularly moved between a first position in which they are oriented parallel to the bottom side and a position in which they are lifted and oriented at an angle relative thereto, as well as a plurality of flexible elements for removable fixation of the booster seat. The seating surface of the booster seat comprises, on its rear side, at least one compartment formed below at least one of the wings, for which the wing forms a closing cover.

9 Claims, 7 Drawing Sheets

BOOSTER SEAT FOR CHILDREN

TECHNICAL FIELD

The present invention relates to a booster seat for children comprising a seating surface adapted for engagement with the seating surface of an adult chair, lateral armrest sides, a backrest, at least one pair of wings connected to the rear side of the seating surface of said booster seat, and designed to be angularly moved between a first position in which they are oriented parallel to said side and a position in which they are lifted and oriented at an angle relative to such side of the seating surface, as well as a plurality of flexible elements for removable fixation of the booster seat to said adult chair, when the booster seat is placed thereon.

BACKGROUND OF THE INVENTION

The booster seat is a well-known accessory in the field of furniture for children and typically consists of the upper part of a high chair, that is designed to be separated from the base and placed on the seating surface of a common adult chair.

Such arrangement allows, for instance, children to sit at the same table as adults, and is particularly useful when a child is too small to use a normal adult chair but has grown enough to find the high chair too narrow and uncomfortable.

The booster seat is fixed by means of special flexible elements, preferably in the form of belts, which are preferably connected to the seating surface of the booster seat and are wrapped around the backrest or the seating surface of the chair to ensure stability thereof.

If required, the child may be secured to the booster seat using the usual shoulder straps and safety belts as required by applicable standards between the lateral sides and on the seating surface.

As is known, the booster seat also has wings attached to the face that underlies the seating surface, to set at least two different level positions of the seating surface of the booster seat when the latter is placed on the chair.

These wings are hinged to said face and may assume a position flat against such face and a position at a predetermined angle therewith, in which they can be locked.

The booster seat can be laid upon the seating surface of the adult chair both when the wings are in the flat position, to set a first level of the seating surface, and when the wings have been lifted at an angle and locked in position, to set a second level for the seating surface of the booster seat.

According to the prior art, when the flexible elements, preferably belts, for stably securing the booster seat to the chair are not in use, for example when the booster seat is placed again on the base of a high chair, they hang freely at the sides of the base, thereby hindering the movements of the high chair as well as the operations for positioning the booster seat on the base.

The object of the present invention is to provide a booster seat in which the flexible elements required for fixation to a seating surface of a chair do not cause hindrance when not in use, e.g. when the booster seat is removed from the base of the high chair or when it is placed on such base.

SUMMARY OF THE INVENTION

These and other objects, as better explained hereafter, are fulfilled by a booster seat as defined in one or more of the accompanying claims.

BRIEF DESCRIPTION OF THE FIGURES

The invention will be now described in greater detail with reference to the annexed drawings, which show a preferred embodiment of the invention, given by way of illustration and without limitation, in which.

DETAILED DESCRIPTION OF THE INVENTION

Figure 1:
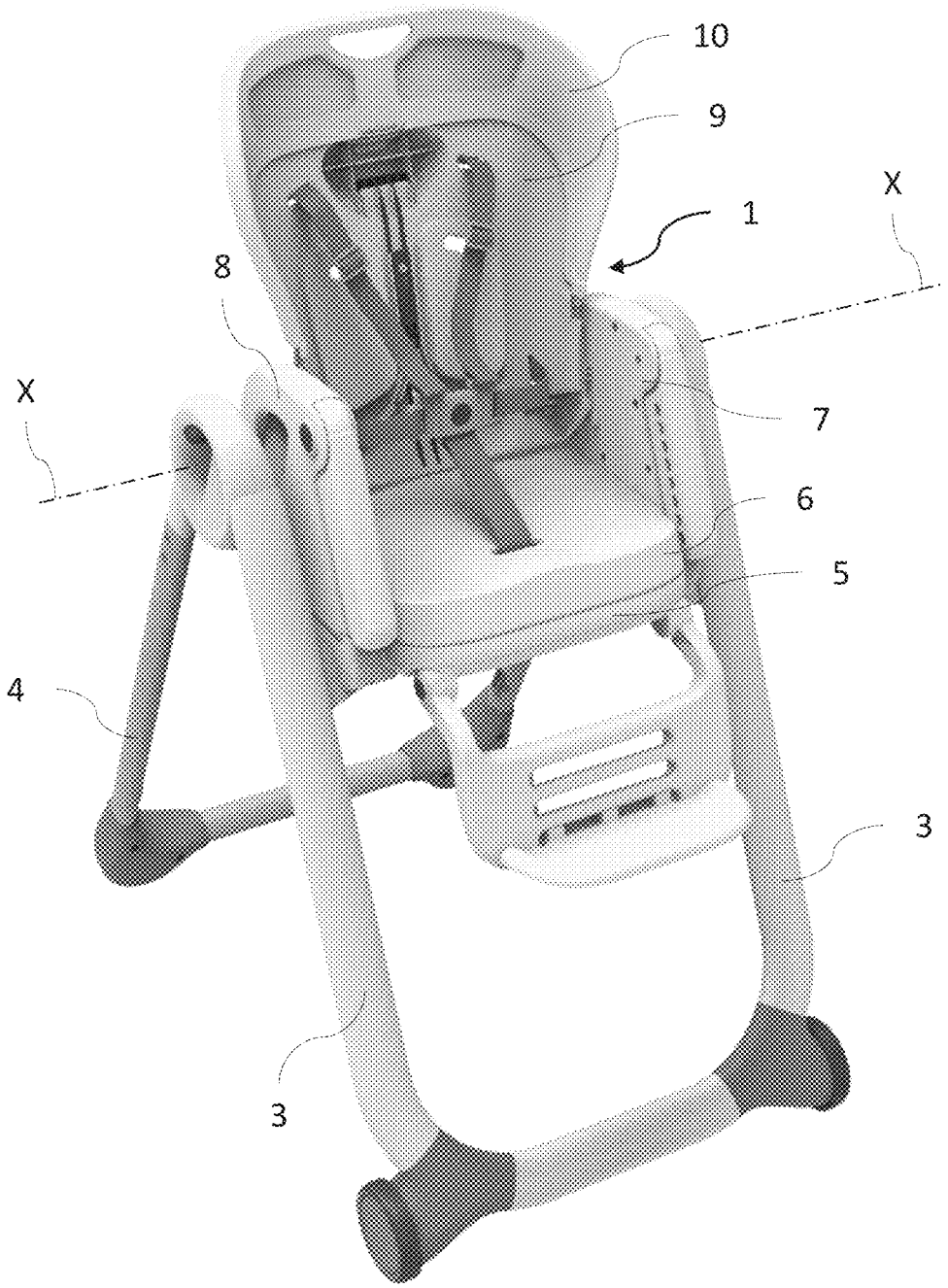
FIG. 1 shows a perspective view of the structure of a high chair for children whose upper part may be removed from the base and be employed as a booster seat.

Referring to the accompanying figures, and particularly to FIG. 1, the high chair of the invention comprises an upper part, generally referenced 1, and a base, generally referenced 2.

In the illustrated embodiment, the base 2 comprises two structures, referenced 3 and 4 respectively, which are composed of tubular elements bent into a C configuration.

These structures are hinged along a horizontal connection axis X-X about which they can be opened and folded in tripod fashion, as is known in the art.

The base 2 has a surface 5 designed to have the upper part 1 removably laid thereon to form a child seat, the latter having a corresponding seating surface 6.

The seating surface 6 has to the lateral sides 7 and 8 and the backrest 9 connected thereto, and the backrest 9, as required by safety standards, has an enlargement 10 that extends in cantilever fashion from its perimeter boundary.

Figure 2:
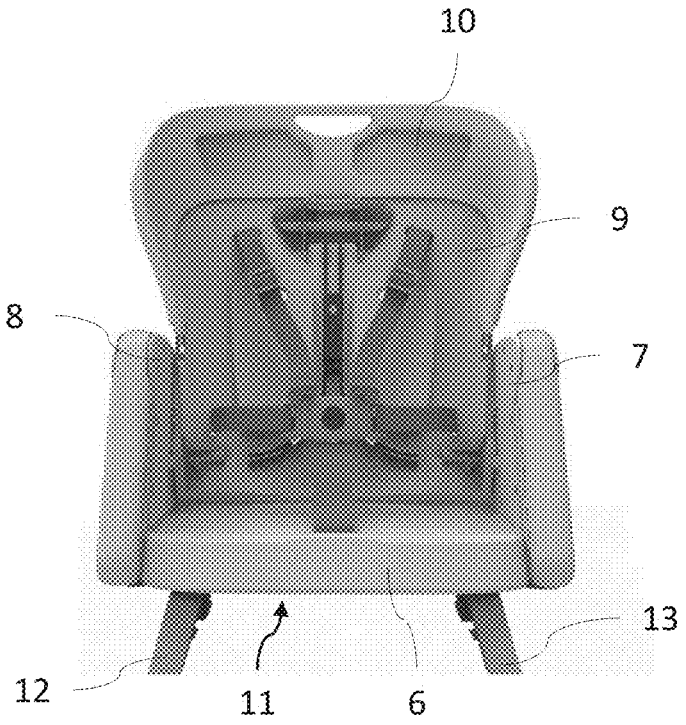
FIG. 2 shows the upper part of the high chair of FIG. 1, removed from the base and configured as a booster seat in the high-level position.
Figure 4:
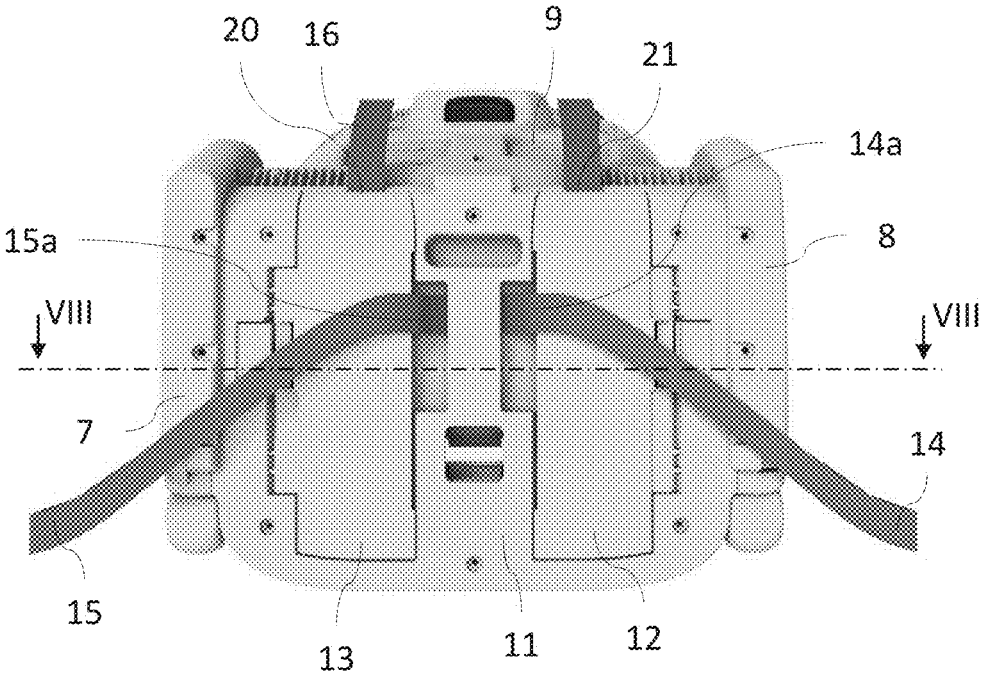
FIG. 4 shows a bottom view of the booster seat of FIG. 2, with the seating surface lifting wings in the love-level position.
Figure 3:
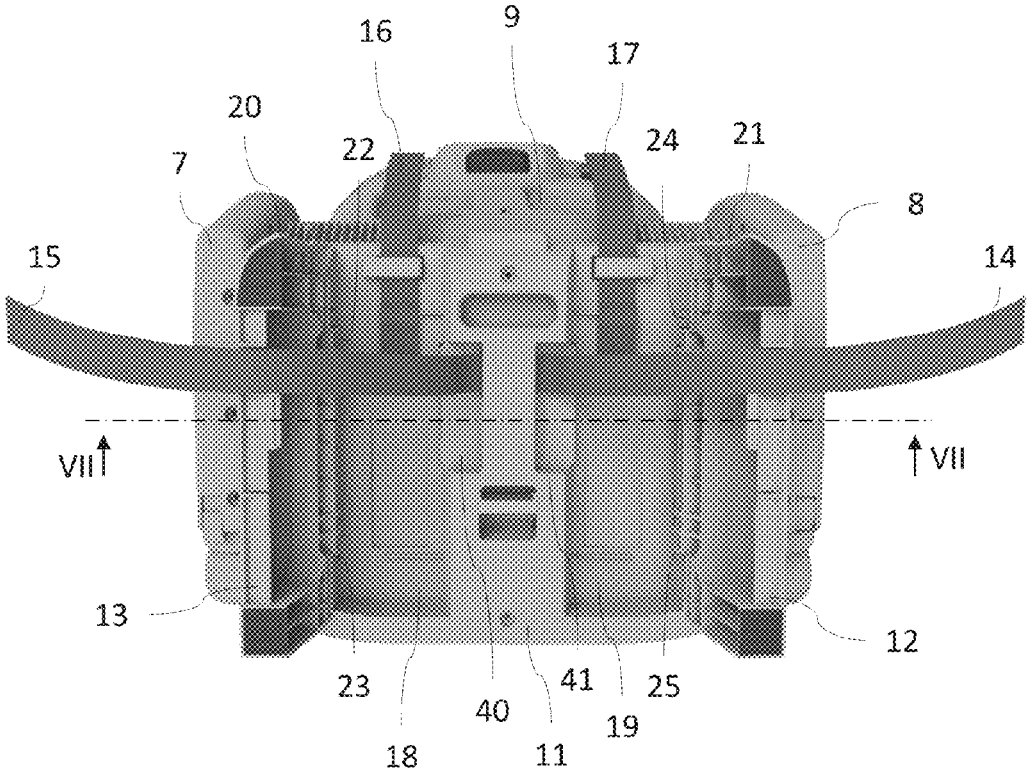
FIG. 3 shows a bottom view of the booster seat of FIG. 2.

Particularly referring to FIGS. 2 and 3, it will be appreciated that, when the upper part 1 of the high chair is removed from the base 2, once conventional lock members, not shown, have been loosened, it can be used as a booster seat, by placing it on the seating surface of a conventional adult chair, not shown.

The bottom side 11 of the seating surface 6 is equipped with conventional wings 12 and 13 that are designed to be angularly moved between a first position in which they are oriented parallel to such bottom side 11 and a position in which they are lifted and oriented at an angle to such side of the seating surface, as shown in FIG. 2.

The upper part 1 of the high chair can be laid upon the seating surface of the adult chair both when the wings 12 and 13 are parallel to the side 11 to set a first level for the seating surface 6, and when the wings 12 and 13 have been lifted at an angle and locked in position, to set a second level for the seating surface 6 of the booster seat.

Numerals 14, 15, 16 and 17 designate respective conventional flexible elements, preferably having the form of flat belts, for fixing the booster seat, once it has been placed on the seating surface of an adult chair, to the seating surface and the backrest of the chair respectively. According to the invention, the seating surface 6, whose bottom surface 11 is adapted for engagement with the seating surface of the adult chair, comprises a compartment 18 formed below the wing 13 and a compartment 19 formed below the wing 12.

Therefore, when the wings 12 and 13 are flat on the surface 11, they form closing covers for the respective compartments 18 and 19.

When the belts 14 and 15, with their ends 14*a* and 15*a* fixed to the bottom side 11 of the seating surface and the other ends freely hanging, are not used to fix the booster seat to the adult chair, they can be rolled or folded to be accommodated in the compartments 18 and 19 and held therein by their respective covers, formed by the wings 12 and 13.

The interior space of the compartments 18 and 19 is sufficient to accommodate at least the flexible elements 15 and 16, and 14 and 17 respectively, when not in use.

Figure 5:
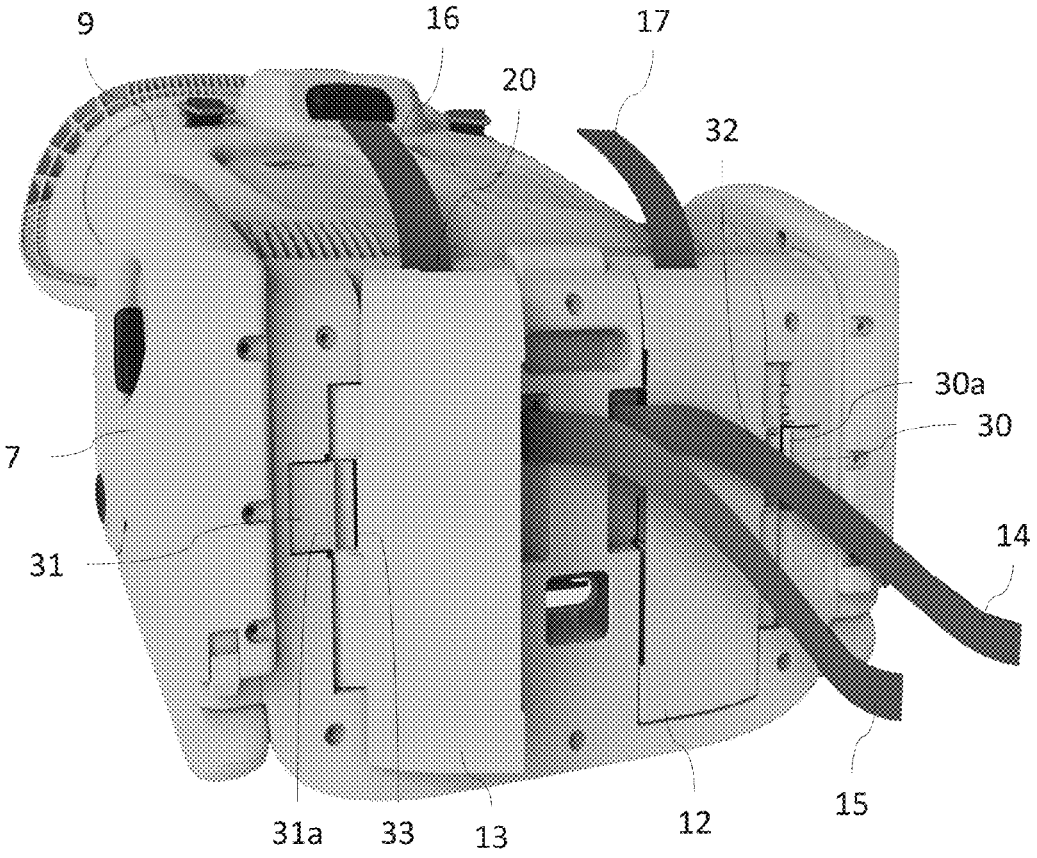
FIG. 5 shows a bottom view of the booster seat of FIG. 2, with one of the lifting wings being opened.
Figure 6:
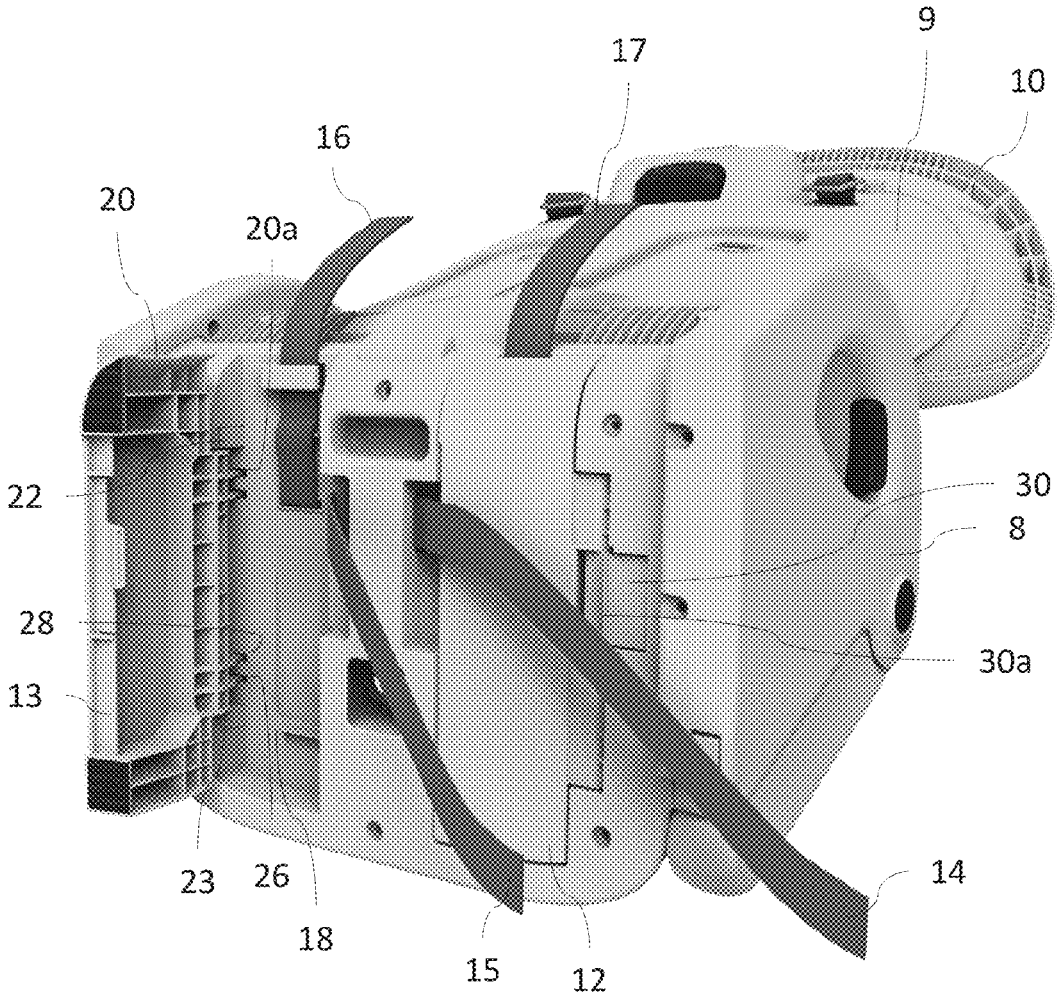
FIG. 6 shows a bottom view of the booster seat of FIG. 2, with one of the lifting wings already opened.

Particularly, referring to FIGS. 5 and 6, it can be noted that the belts 16 and 17 have their first ends 16*a*, 17*a* directly fixed to the bottom of their respective compartments 18 and 19 and the respective wings 12 and 13 have respective openings 20, 21 for the belts to extend therethrough and allow the booster seat to be secured even with the wings 12 and 13 closed back and with the booster seat configured in the low-level position, with respect to the seating surface of the chair.

Figure 9:
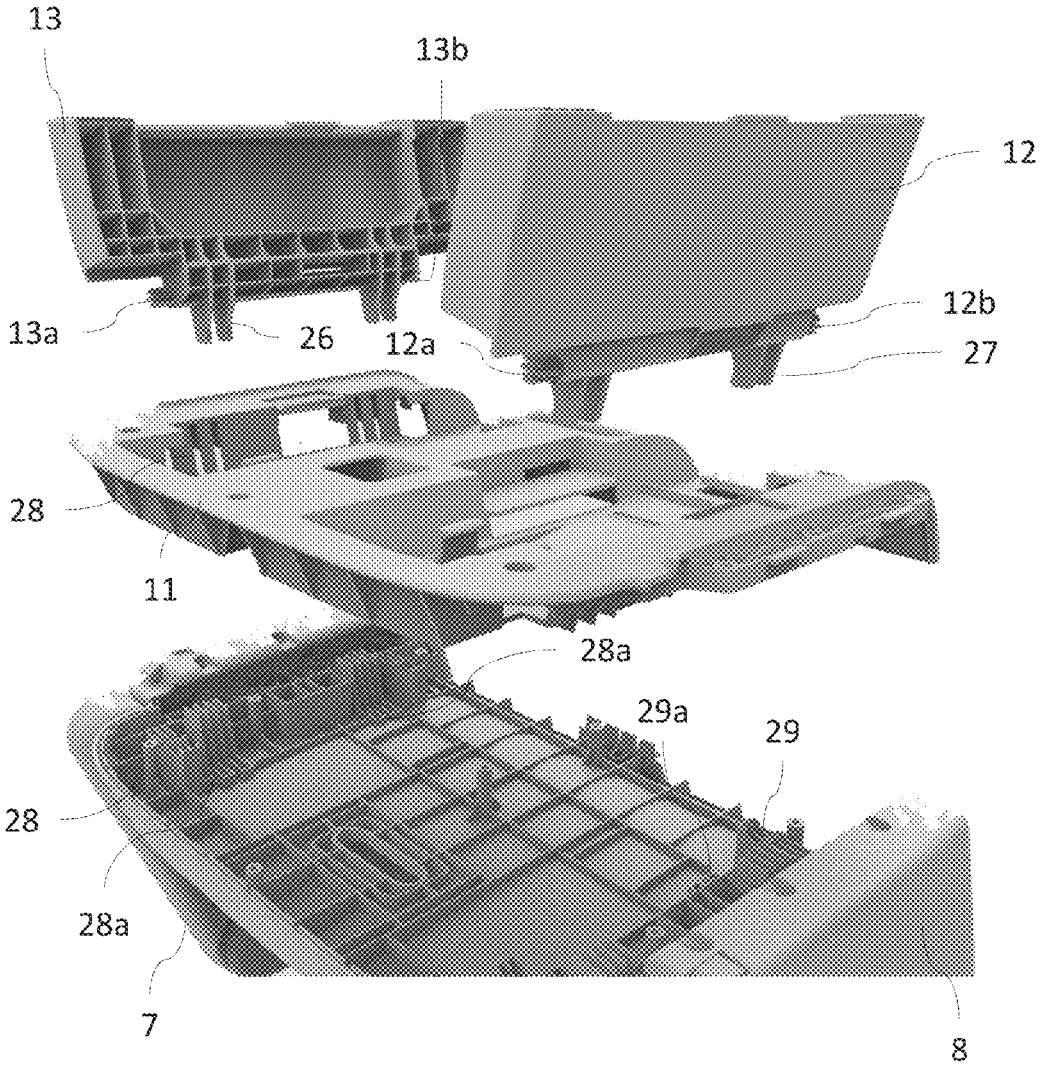
FIG. 9 shows an exploded perspective view of the structure of the seating surface with the wings of the inventive booster seat already opened.

In order to allow for angular displacements of the wings 12 and 13 from the position in which they close the compartments 18 and 19 to the predetermined lifted position, forming an angle of more than 90° with the closing position, and to ensure the stability of the booster seat when it is placed on the seating surface of the chair, each wing has pins 12*a*, 12*b*, and 13*a*, 13*b* respectively, as shown in FIG. 9, which engage in respective supports 22, 23 and 24, 25 (see FIG. 3) formed on the wall of the respective compartments 18 and 19, on the hinging side of the respective wing.

Abutment members are provided to lock the position of the wings 12 and 13 when they have been opened. These members comprise a plurality of stems 26, 27 rigidly joined to their respective wings 12 and 13 and projecting out of the side with the pin, and corresponding openings 28, 29 formed on the wall of the compartment on whose side the hinging pin of the wing is mounted.

These openings 28, 29 also extend on the bottom wall of the compartment and each compartment is slidingly engaged within a respective opening during the angular movement of the wing to open and close the compartment.

According to the invention, each stem 26, 27 has such a size as to stop the angular displacement of the respective wings 12 and 13 as the latter are being lifted into the predetermined position, when the ends of the stems abut the edges 28*a* and 29*a* of their respective openings.

Figure 7:
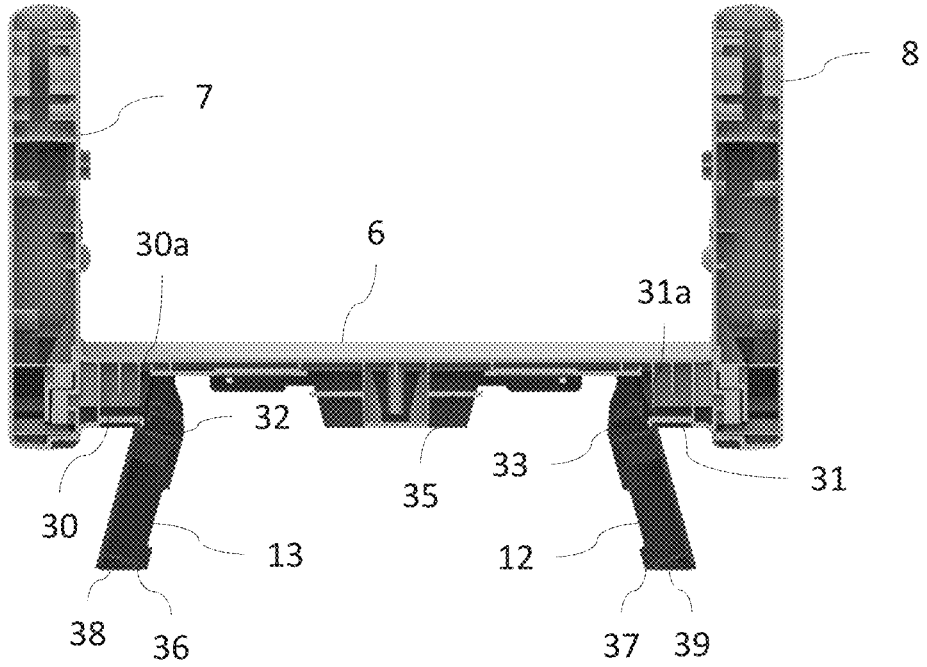
FIG. 7 shows a cross sectional view as taken along lines VII-VII of FIG. 3.
Figure 8:
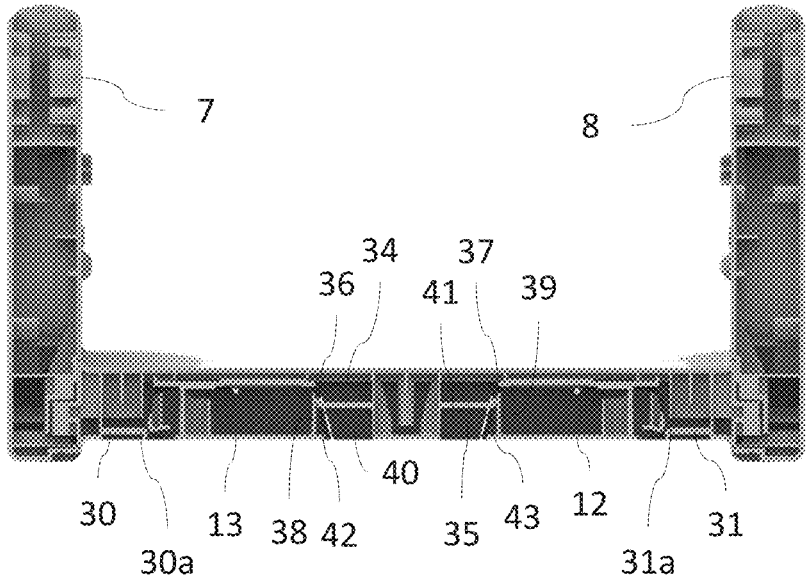
FIG. 8 shows a cross sectional view as taken along lines VIII-VIII of FIG. 4.

Particularly referring to FIGS. 5, 7 and 8, it can be noted that snap-fit engagement and disengagement members between the wing 12 or 13 and the rear side 11 of the seating surface 7 for holding the open position preferably comprise plates 30, 31 which are flexibly fixed in cantilever fashion on the bottom side 11 of the seating surface 6 with their respective free ends 30*a*, 31*a* facing toward the side of the wing with the pin, being curved into a hook shape.

Such engagement and disengagement members further comprise respective openings 32, 33 formed in the wall of the wings for receiving the hook-shaped ends when the wings are in the open position. Thus, the hook-shaped free ends 30*a*, 31*a* are adapted for snap-fit engagement and disengagement with the edge of these respective openings 32, 33.

According to the invention, member are also provided for snap-fit retention and release of each wing 12, 13 when the latter is in its respective compartment closing position. These members comprise a plate 34 formed in the internal honeycomb structure of the seating surface 6 and facing the interior of the compartment 18, as well as a corresponding plate 35 facing the interior of the compartment 19.

The free ends 34*a*, 35*a* of these plates 34, 35, when the wings 12 and 13 are in the positions in which they close the respective compartments 18, 19, are engaged beneath respective ribs 36, 37 of respective plates 38, 39 carried by the honeycomb structure of the wings.

In order to open the wings 12, 13 when they are in the closing position, as shown in FIG. 8, the bottom side 11 of the seating surface 6 has respective cavities 40, 41, level with the lifting side of each wing 12, 13, for accessing, e.g. with the fingers of one hand, respective flexible wings 42, 43 supported in cantilever fashion by the structure of the surface 11, with their free ends abutting the ribs 36 and 37 of the plates 38 and 39 respectively.

It may be appreciated from the above disclosure that the wings 12 and 13 may be lifted by manually pressing the flexible wings 42, 43, to disengage the ribs 36, 37 from the ends of the plates 34, 35.

Once the wings 12 and 13 have been lifted to the desired angular position, they are stably secured by engagement of their respective openings 32, 33 with the hook-shaped ends of the plates 30 and 31.

By a reverse procedure, the wings are unlocked and stably closed on the compartments 18 and 19.

The invention is susceptible of variant embodiments, falling within the scope of the following claims.

The invention claimed is:

1. A booster seat for children, comprising a seating surface for engagement with the seating surface of an adult chair, a backrest, at least one pair of wings connected to a bottom side of the seating surface of said booster seat and designed to be angularly moved between a first position in which they are oriented parallel to said bottom side and a position in which they are lifted and oriented at an angle to such side of the seating surface, as well as a plurality of flexible elements for removable fixation of the booster seat to an adult seat, when the booster seat is placed thereon, wherein said seating surface, in its bottom surface adapted for engagement with the seating surface of the adult chair, comprises at least one compartment formed below at least one of said wings, the wing forming a closing cover therefor, wherein an opening is provided between the wing and the underlying compartment closed thereby, for passage of said flexible element even when the wing is in a compartment-closing position.

2. The booster seat for children as claimed in claim 1, wherein the booster seat comprises a compartment formed below each of said wings which form respective covers therefor.

3. The booster seat for children as claimed in claim 2, wherein at least one of said flexible elements for removable fixation of the booster seat comprises a first end which is fixed to said seating surface of the booster seat at one point inside its respective compartment of said compartments formed below said wings, the compartment having enough room to contain at least the whole of said flexible element when said flexible element is not in use.

4. The booster seat for children as claimed in claim 3, wherein said flexible elements are in belt form and their free ends have members for removable connection to the end of another flexible element.

5. A booster seat for children, comprising a seating surface for engagement with the seating surface of an adult chair, a backrest, at least one pair of wings connected to a bottom side of the seating surface of said booster seat and designed to be angularly moved between a first position in which they are oriented parallel to said bottom side and a position in which they are lifted and oriented at an angle to such side of the seating surface, as well as a plurality of flexible elements for removable fixation of the booster seat to an adult seat, when the booster seat is placed thereon, wherein said seating surface, in its bottom surface adapted for engagement with the seating surface of the adult chair, comprises at least one compartment formed below at least one of said wings, the wing forming a closing cover therefor, wherein each wing comprises a respective pin whereby it is hinged to one side of its respective compartment for which it forms a closing cover, and is designed to be angularly moved between said closing position and a predetermined lifted position which forms an angle of more than 90° to the closing position, abutment members and lock members being provided to respectively stop the wing and to stably fix it in the predetermined lifted position.

6. The booster seat for children as claimed in claim 5, wherein said abutment members comprise a plurality of stems rigidly joined to the wing and projecting out of the side with the pin, and corresponding openings formed on a wall of the compartment on whose side the hinging pin of the wing is mounted, each stem being slidingly engaged within a respective one of said openings as the compartment is opened and closed, and stopping the angular movement of the wing, as said wing is being lifted, when ends of the stems abut one edge of the respective openings.

7. The booster seat for children as claimed in claim 5, wherein said lock members for stably fixing the wing in the predetermined lifted position comprise members for snap-fit engagement and disengagement of the wing with a rear side of said seating surface.

8. The booster seat for children as claimed in claim 7, wherein said members for snap-fit engagement and disengagement comprise a plate, which is flexibly fixed in cantilever fashion on the rear side of said seating surface, with a free end that faces toward the side of the wing with the pin, being curved into a hook shape, an opening formed in a wall of the wing, said free end being adapted for snap-fit engagement and disengagement with an edge of said opening.

9. The booster seat for children as claimed in claim 1, wherein the booster seat comprises members for snap-fit retention and release of each wing when said wing is in a respective compartment closing position.

* * * * *